US007301088B2

(12) United States Patent
Chen

(10) Patent No.: US 7,301,088 B2
(45) Date of Patent: Nov. 27, 2007

(54) ADJUSTABLE DRUM PEDAL ASSEMBLY

(76) Inventor: Kuo-Chang Chen, No. 32, Doutan Rd., Shalu Chen, Taichung Hsien (TW)

( * ) Notice: Subject to any disclaimer, the term of this patent is extended or adjusted under 35 U.S.C. 154(b) by 181 days.

(21) Appl. No.: 11/335,496

(22) Filed: Jan. 20, 2006

(65) Prior Publication Data

US 2007/0169611 A1 Jul. 26, 2007

(51) Int. Cl.
*G10D 13/02* (2006.01)

(52) U.S. Cl. ..... 84/422.1

(58) Field of Classification Search ..... 84/422.1
See application file for complete search history.

(56) References Cited

U.S. PATENT DOCUMENTS 5,365,824 A * 11/1994 Hoshino ..... 84/422.1
5,646,360 A * 7/1997 Liao ..... 84/422.1
6,239,342 B1 * 5/2001 Chang ..... 84/422.1
6,649,820 B2 * 11/2003 Sassmannshausen ..... 84/422.1
6,822,149 B1 * 11/2004 Liao ..... 84/422.1
2003/0047060 A1 * 3/2003 Cocca ..... 84/422.1
2003/0226442 A1 * 12/2003 Dennis et al. ..... 84/422.1
2007/0107582 A1 * 5/2007 Hauck ..... 84/422.1
2007/0113722 A1 * 5/2007 Chen ..... 84/422.1
2007/0169611 A1 * 7/2007 Chen ..... 84/422.1

* cited by examiner

*Primary Examiner*—Lincoln Donovan
*Assistant Examiner*—Robert W. Horn
(74) *Attorney, Agent, or Firm*—Rabin & Berdo, P.C.

(57) ABSTRACT

An adjustable drum pedal assembly has a pedal assembly, a drive device and a return device. The pedal assembly is used to operate the adjustable drum pedal assembly and has a pedal, a rotating shaft and a drum hammer. The drive device is connected to the pedal and is mounted on and rotates the rotating shaft. The return device is mounted on the rotating shaft, attached to the pedal assembly, returns the drum hammer and has a rotating bracket, a rotating connector, a spring, a stationary bracket and a pivoting connector. The rotating bracket and connector are attached to the rotating shaft. The spring is connected to the rotating connector. The stationary bracket is attached to the pedal assembly. The pivoting connector is mounted pivotally in the stationary bracket and connects to the spring.

2 Claims, 6 Drawing Sheets

ADJUSTABLE DRUM PEDAL ASSEMBLY

BACKGROUND OF THE INVENTION

1. Field of the Invention

The present invention relates to a drum pedal assembly, and more particularly to an adjustable drum pedal assembly so the pedal can be adjusted to be depressed nimbly and easily.

2. Description of Related Art

With reference to FIG. 6, a conventional drum pedal assembly generally comprises a pedal assembly (50), a drive device (60) and a return device (70).

The pedal assembly (50) comprises a baseplate (51), two posts (52), a pedal (55), a rotating shaft (53) and a drum hammer (54).

The baseplate (51) sits on a floor next to a drum and has a front end and a rear end.

The posts (52) are mounted on and extend up from the baseplate (51) parallel to each other near the front end. Each post (52) has a distal end, a proximal end and a pivot hole. The proximal ends of the posts (52) are mounted on the baseplate (51). The pivot holes are defined respectively through the distal ends of the posts (52) and face and are aligned with each other.

The drum pedal (55) is pivotally connected to the baseplate (51) and has a rear end and a front end. The rear end of the drum pedal (53) is connected pivotally to the baseplate (51).

The rotating shaft (53) has a non-circular cross section, is mounted rotatably in the pivot holes in the posts (52) and has two ends. The ends of the rotating shaft (53) are mounted respectively in the pivot holes of the posts (52). One end extends through the corresponding pivot hole.

The drum hammer (54) is attached to and extends transversely from the rotating shaft (53), pivots and strikes a drum when the rotating shaft (53) rotates and has a distal end, a proximal end and a through hole. The through hole is defined transversely near the proximal end of the drummer hammer (54), has a non-circular cross section corresponding to the cross section of the rotating shaft (53) and is attached securely to the rotating shaft (53).

The drive device (60) is mounted on and rotates the rotating shaft (53), is connected to the pedal (55) and has a shaft connector (61) and a chain (62). The shaft connector (61) is wedge shaped, is mounted eccentrically on the rotating shaft (53) and has a curved outer edge, two sides, a transverse through hole and a setscrew. The curved outer edge has a groove and a threaded hole. The groove has an upper end and a lower end. The threaded hole is formed radially in the groove near the upper end. The transverse through hole is formed through the shaft connector (61) between the two sides, communicates with the threaded hole, has a non-circular cross section corresponding to the cross section of the rotating shaft (53) and is mounted on the rotating shaft (53). The setscrew screws into the threaded hole and presses against the rotating shaft (53) to hold the shaft connector (61) in place on the rotating shaft (53).

The chain (62) is connected to the drum pedal (55) and the shaft connector (61) and has a proximal end and a distal end. The proximal end is connected to the front end of the drum pedal (55). The distal end is mounted in the groove in the curved outer edge of the shaft connector (61) and is connected to the shaft connector (61) by the setscrew screwed into the threaded hole so the chain (62) rotates the shaft connector (61) and the rotating shaft (53), which pivots the drum hammer (54) and causes the drum hammer (54) to strike the drum when the pedal (55) is pressed down.

The return device (70) is mounted on the baseplate (51) adjacent to one of the posts (52), is connected to the end of the rotating shaft (53) extending through the corresponding pivot hole in the post (52), rotates the rotating shaft (53) so the drum hammer (54) is in an upright position when the pedal (55) is not pressed down and has a rotating bracket (72), a rotating connector (73), a base (75), a stationary connector (74) and a spring (71).

The rotating bracket (72) is attached to the end of the rotating shaft (53) extending through the corresponding pivot hole and has a transverse mounting hole and a lower end. The transverse mounting hole is securely mounted on the rotating shaft (53).

The rotating connector (73) is attached to the lower end of the rotating bracket (72) and has a front end, a rear end and a transverse mounting hole. The front end of the rotating connector (73) is attached securely to the rotating bracket (72). The transverse mounting hole is formed transversely through the rotating connector (73) near the rear end.

The base (75) is mounted on the posts (52) corresponding to the rotating bracket (72) and has a threaded mounting hole. The threaded mounting hole is formed vertically through the base (75).

The stationary connector (74) is attached to and extends up from the base (75) and has a proximal end, a distal end, a transverse mounting hole and an external thread. The transverse mounting hole is formed on the distal end of the stationary connector (74). The external thread is formed on the proximal end of the stationary connector (74) and is screwed into the threaded mounting hole in the base (75).

The spring (71) is attached to the rotating connector (73) and the stationary connector (74) and has two hooks. The hooks are mounted respectively in the transverse mounting holes in the rotating connector (73) and the stationary connector (74) so the spring (71) pulls the rotating connector (73) down when the pedal (55) is not pressed down, pivots the rotating shaft (53) and returns the drum hammer (54) to an upright position. Defects and shortcomings of the conventional drum pedal assembly (50) follow.

1. The return device (70) is attached in a fixed position to the drum pedal assembly (50), and the spring (71) cannot follow the rotating connector (73) and the rotating bracket (72). Consequently, more force must be applied to the pedal (55) to operate the conventional drum pedal assembly (50).

2. Where the stationary connector (74) and the spring (71) are mounted is not adjustable so the conventional drum pedal assembly (50) is not versatile in use.

SUMMARY OF THE INVENTION

The main objective of the present invention is to provide an adjustable drum pedal assembly that operates easily.

An adjustable drum pedal assembly has a pedal assembly, a drive device and a return device. The pedal assembly is used to operate the adjustable drum pedal assembly and has a pedal, a rotating shaft and a drum hammer. The drive device is connected to the pedal and is mounted on and rotates the rotating shaft. The return device is mounted on the rotating shaft, attached to the pedal assembly, returns the drum hammer and has a rotating bracket, a rotating connector, a spring, a stationary bracket and a pivoting connector. The rotating bracket and connector are attached to the rotating shaft. The spring is connected to the rotating connector. The stationary bracket is attached to the pedal assembly. The pivoting connector is mounted pivotally in the stationary bracket and connects to the spring.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
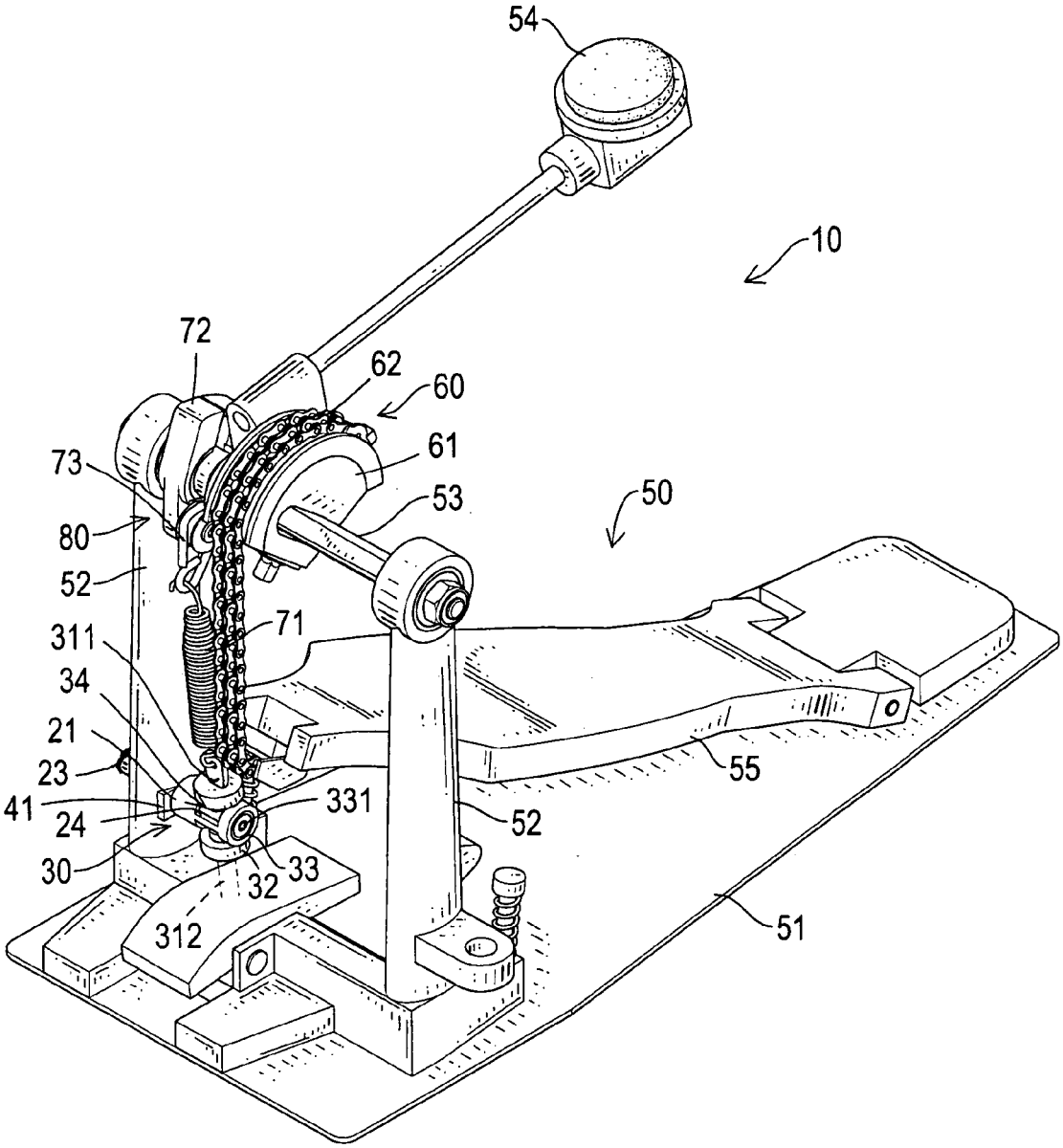
FIG. 1 is a perspective view of an adjustable drum pedal assembly in accordance with the present invention.
Figure 2:
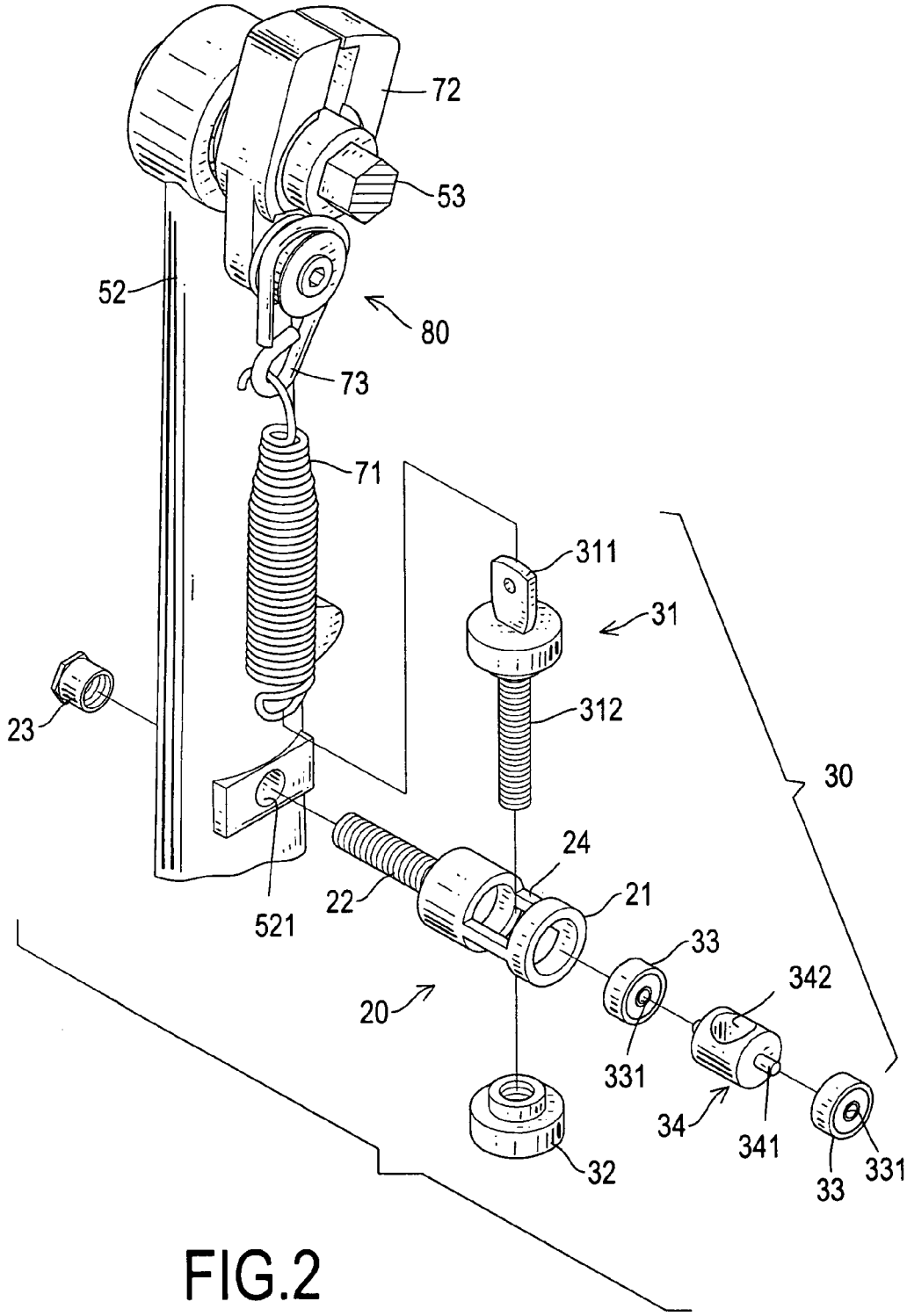
FIG. 2 is an enlarged exploded perspective view in partial section of the adjustable drum pedal assembly in FIG. 1.
Figure 3:
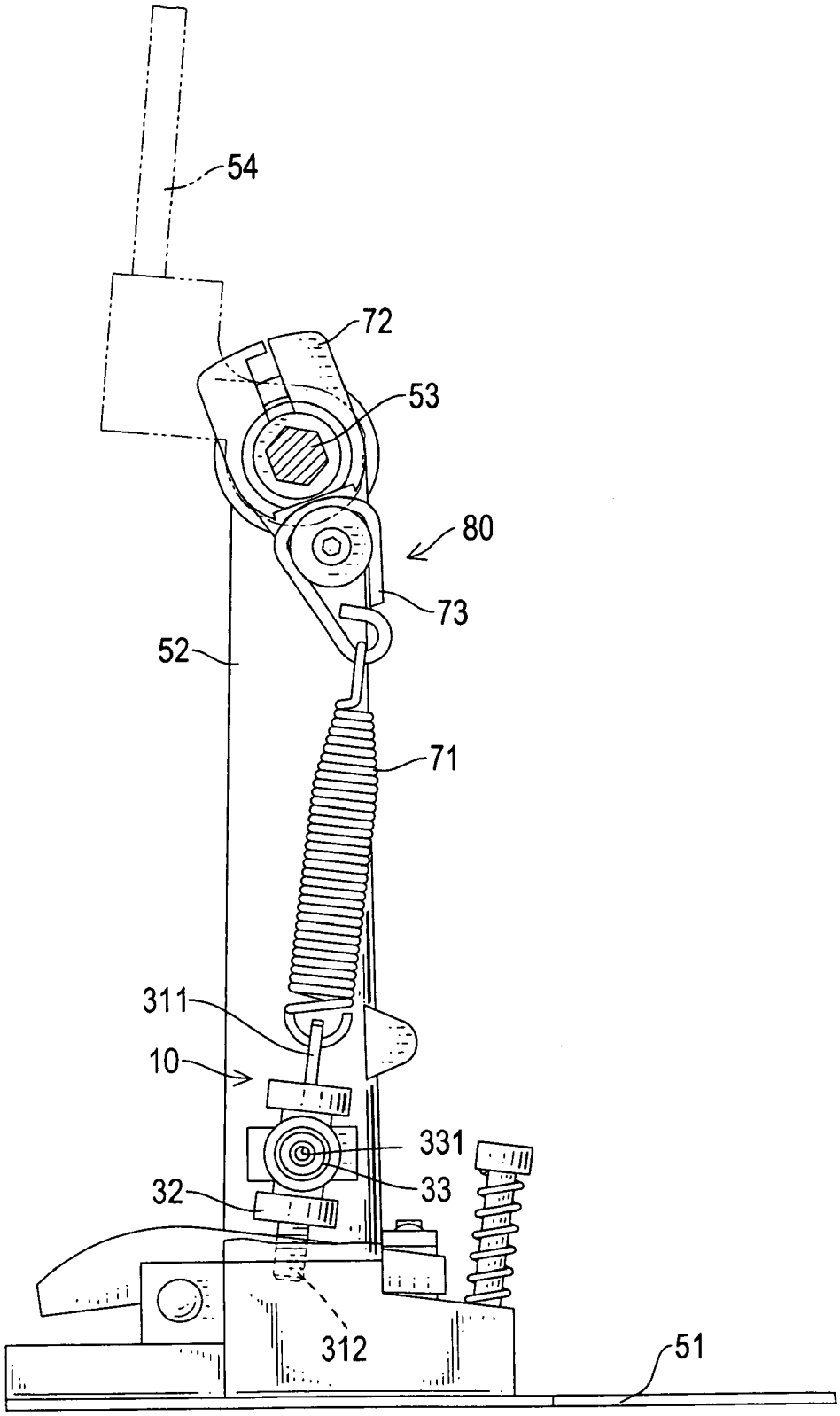
FIG. 3 is an operational perspective view of the adjustable drum pedal assembly in FIG. 1.

With reference to FIGS. 1, 2 and 3, an adjustable drum pedal assembly (10) in accordance with the present invention comprises a pedal assembly (50), a drive device (60) and a return device (80).

Figure 5:
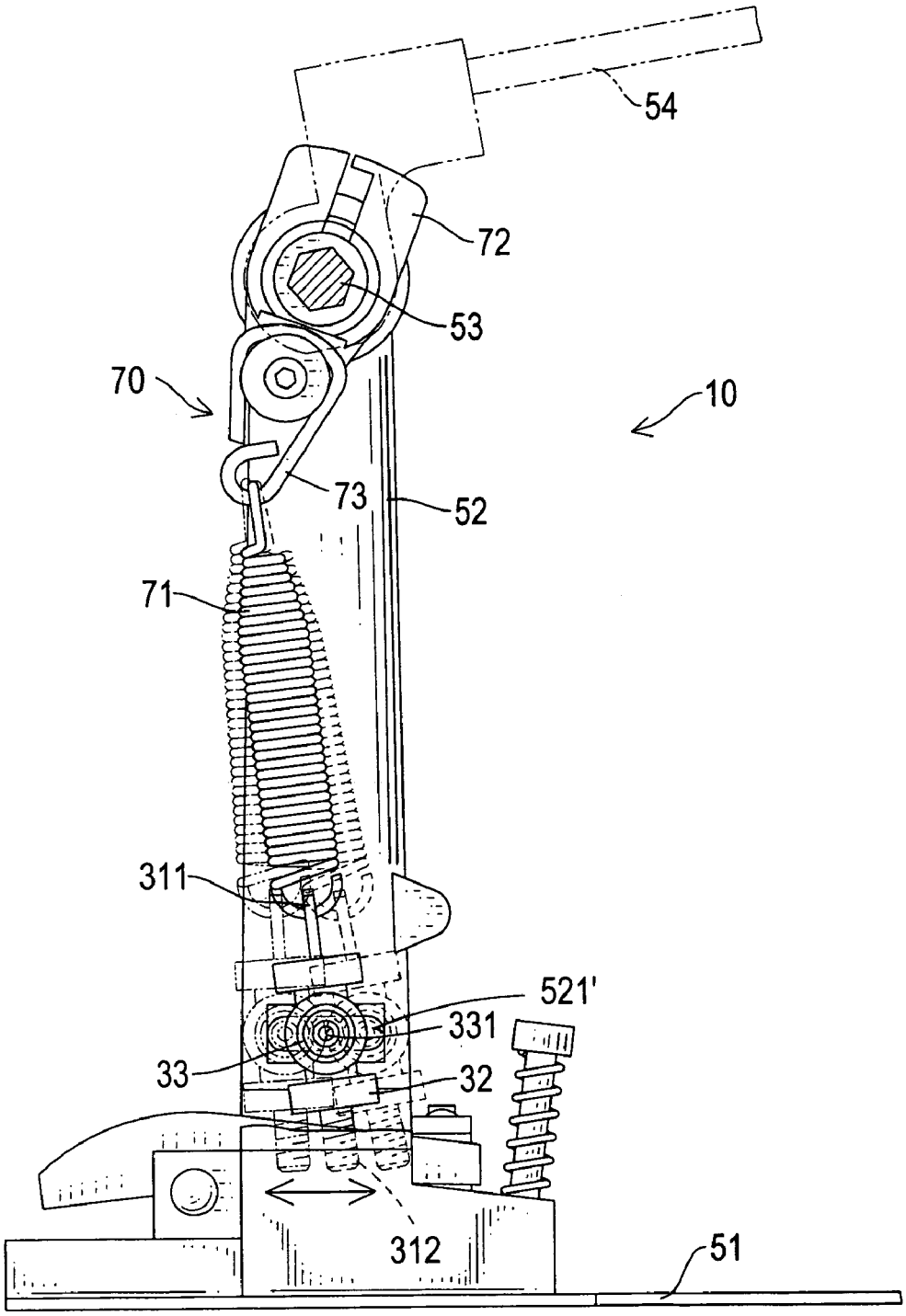
FIG. 5 is an operational perspective side view in partial section of another embodiment of a adjustable drum pedal assembly in accordance with the present invention.
Figure 6:
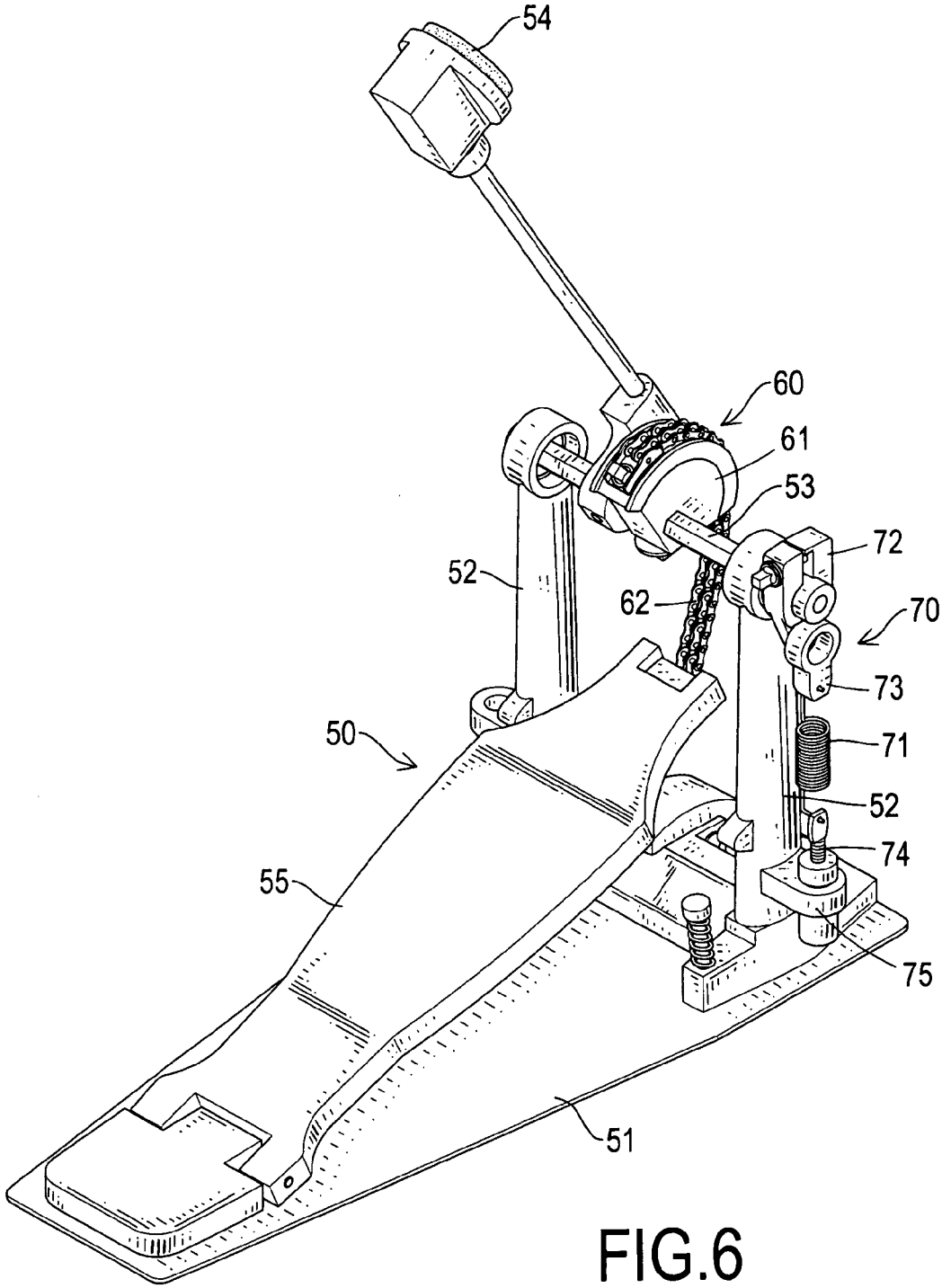
FIG.6 PRIOR ART
FIG. 6 is a perspective view of a conventional drum pedal assembly in accordance with the prior art.

With further reference to FIG. 5, the pedal assembly (50) comprises a baseplate (51), two posts (52), a pedal (55), a rotating shaft (53) and a drum hammer (54).

The baseplate (51) has a front end and a rear end.

The posts (52) are mounted on and extend up from the baseplate (51) parallel to each other near the front end. Each post (52) has a distal end, a proximal end and a pivot hole, and one of the posts (52) has a transverse through hole (521). The proximal ends of the posts (52) are mounted on the baseplate (51). The pivot holes are defined respectively through the distal ends of the posts (52) and face and are aligned with each other. The transverse through hole (521) is formed through the post (52) near the proximal end of the post (52) and may be horizontally elongated hole (521').

The pedal (55) is connected pivotally to the baseplate (51) near the rear end of the baseplate (51) and has a rear end and a front end. The rear end of the drum pedal (53) is connected pivotally to the baseplate (51) near the rear end of the baseplate (51).

The rotating shaft (53) has a non-circular cross section, is mounted rotatably in the pivot holes in the posts (52) and has two ends. The ends of the rotating shaft (53) are mounted respectively in the pivot holes in the posts (52).

The drum hammer (54) is attached to and extends transversely from the rotating shaft (53), pivots and strikes a drum when the rotating shaft (53) rotates and has a distal end, a proximal end and a through hole. The through hole is defined transversely near the proximal end of the drum hammer (54), has a non-circular cross section corresponding to the cross section of the rotating shaft (53) and is attached securely to the rotating shaft (53).

The drive device (60) is mounted on and rotates the rotating shaft (53), is connected to the front end of the pedal (55) and has a shaft connector (61) and a chain (62).

The shaft connector (61) is wedge shaped, is mounted eccentrically on the rotating shaft (53) and has a curved outer edge, two sides, a transverse through hole and a setscrew. The curved outer edge has a groove and a threaded hole. The groove has an upper end and a lower end. The threaded hole is formed radially in the groove near the upper end. The transverse through hole is formed through the shaft connector (61) between the two sides, communicates with the threaded hole, has a non-circular cross section corresponding to the cross section of the rotating shaft (53) and is mounted on the rotating shaft (53). The setscrew screws into the threaded hole and presses against the rotating shaft (53) to hold the shaft connector (61) in place on the rotating shaft (53). The chain (62) is mounted in the groove in the curved outer edge of the shaft connector (61), is connected to the front end of the pedal (55) and the upper end of the groove in the curved outer edge of the shaft connector (61) and has a proximal end and a distal end. The proximal end is connected to the front end of the pedal (55). The distal end is mounted in the groove in the curved outer edge of the shaft connector (61) and is connected to the shaft connector (61) by the setscrew screwed into the threaded hole so the chain (62) rotates the shaft connector (61) and the rotating shaft (53), which pivots the drum hammer (54) and causes the drum hammer (54) to strike the drum when the pedal (55) is pressed down.

The return device (80) is mounted on the rotating shaft (53) between the posts (52) of the pedal assembly (50), is connected to one of the posts (52) and the rotating shaft (53) and has a rotating bracket (72), a rotating connector (73), a spring (71), a stationary bracket (20) and a pivoting connector (30). The rotating bracket (72) is attached to the rotating shaft (53) between the posts (52) and has a transverse mounting hole and a lower end. The transverse mounting hole is mounted securely on the rotating shaft (53) and has a non-circular cross section corresponding to the non-circular cross section of the rotating shaft (53).

The rotating connector (73) is attached pivotally to the lower end of the rotating bracket (72) and has an upper end, a lower end and a transverse mounting hole. The upper end of the rotating connector (73) is attached pivotally to the rotating bracket (72). The transverse mounting hole is formed transversely through the rotating connector (73) near the lower end.

The spring (71) is attached pivotally to the transverse mounting hole in the rotating connector (73) and has an upper hook and a lower hook. The upper hook is mounted pivotally in the transverse mounting hole in the rotating connector (73).

The stationary bracket (20) is attached to the post (52) with the transverse through hole (521) and has a socket (21), a threaded rod (22), a fastener (23) and a drive hole (24). The socket (21) is a tubular and has a front end, a rear end, an internal cavity and an opening. The opening is formed in the front end of the socket (21). The threaded rod (22) is attached to and protrudes longitudinally from the rear end of the socket (21), is mounted through the through hole (521) in the post (52) and may be positioned in the elongated through hole in the post (52) to adjust the operation of the adjustable drum pedal assembly (10). The fastener (23) screws onto the threaded rod (22) and attaches the stationary bracket (20) to the post (52). The drive hole (24) is formed transversely through the socket (21) near the front end and communicates with the internal cavity.

The pivoting connector (30) is mounted in the socket (21) of the stationary bracket (20), is connected to the lower hook of the spring (71) and has two bearings (33), a rotatable collar (34), a drive column (31) and a nut (32). The bearings (33) are mounted in the internal cavity of the socket (21), and each bearing (33) has a center and a transverse mounting hole (331). The transverse mounting holes (331) are formed respectively through the centers of the bearings (33). The rotatable collar (34) is mounted rotatably in the internal cavity of the socket (21) between the bearings (33) and has two ends, two mounting pins (341) and a transverse through hole (342). The mounting pins (341) are formed respectively on and extend from the ends of the rotatable collar (34) and are mounted respectively in the transverse mounting holes (331) in the bearings (33). The transverse through hole (342) is formed through the rotatable collar (34) and communicates with the drive hole (24) in the stationary bracket (20).

Figure 4:
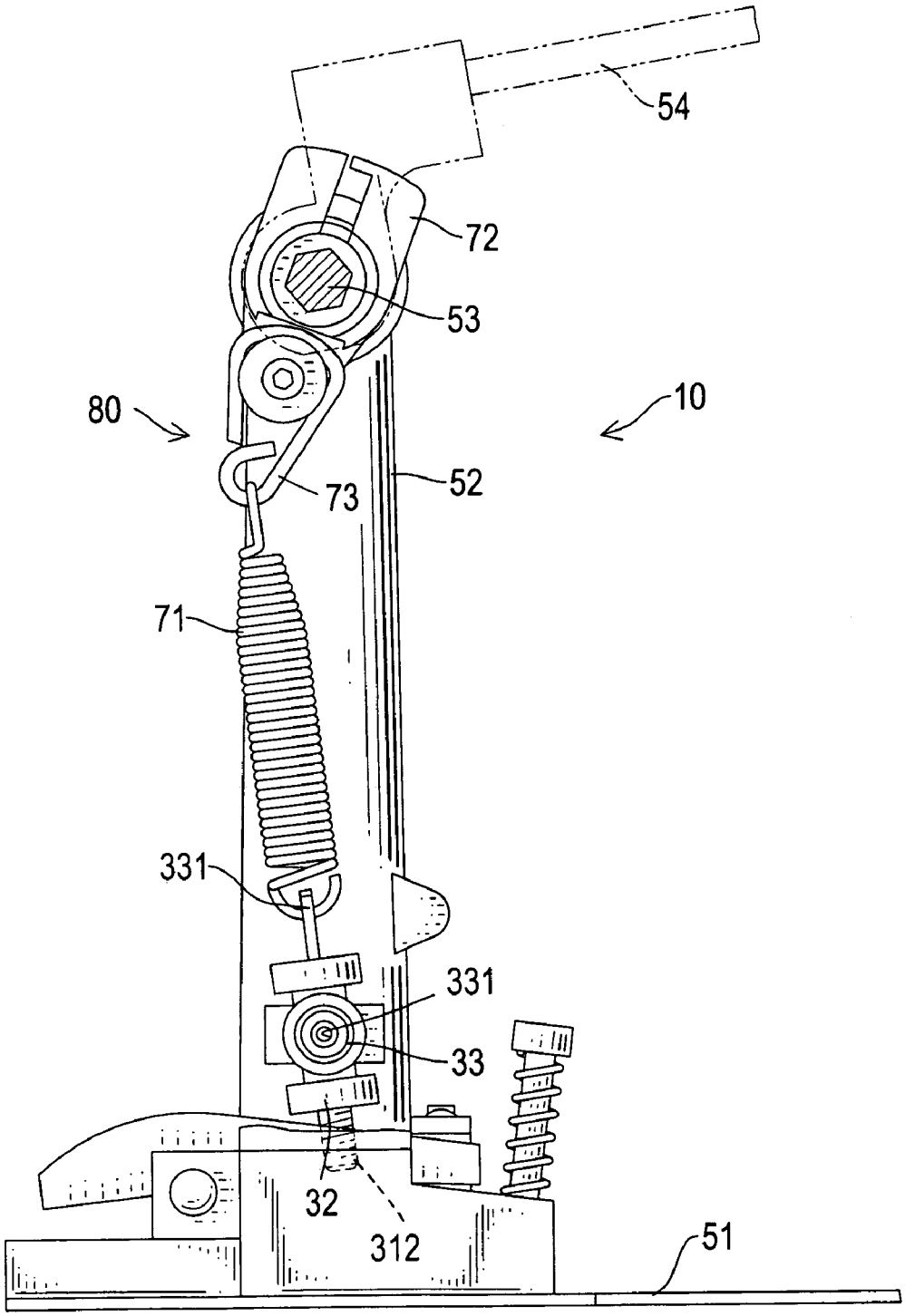
FIG. 4 is an operational perspective side view in partial section of the adjustable drum pedal assembly in FIG. 1.

With further reference to FIGS. 3 and 4, the drive column (31) is mounted pivotally in the stationary bracket (20), is connected pivotally to the lower hook of the spring (71), allows the spring (71) to move when the pedal (55) of the pedal assembly is pressed and released so less pressure is required to press the spring (71) and has an upper end, a lower end, a connecting tab (311) and a threaded shaft (312). The connecting tab (311) is formed on the upper end and has a transverse mounting hole. The transverse mounting hole is formed through the connecting tab (311) and attaches pivotally to the lower hook of the spring (71). The threaded shaft (312) extends through the transverse through hole (342) in the rotatable collar (34) and has a distal end. The nut (32) is screwed onto the distal end of the threaded shaft (312) to hold the drive column (31) in the stationary bracket (20).

The adjustable drum pedal assembly (10) has the following advantages.

1. The spring (71) and the drive column (31) rotate oppositely to the stationary bracket (20) and turn with the rotating shaft (53) by the rotating bracket (72) and the rotating connector (73). Thus, the flexibility of the return device (70) relative to the adjustable drum pedal assembly (10) can be adjusted based on the user's needs.

2. The positions of the drive column (31) and the spring (71) connected to the return device (70) can be adjusted, such that the adjustable drum pedal assembly (10) is versatile in use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjustable drum pedal assembly having
- a pedal assembly
  - a baseplate having
    - a front end; and
    - a rear end;
  - two posts mounted on and extended up from the baseplate parallel to each other near the front end, and each post having
    - a proximal end mounted on the baseplate;
    - a distal end;
    - a pivot hole defined through the distal end of the post and face and aligned with the pivot hole in the other post, wherein one of the posts has a transverse through hole formed through the post near the proximal end of the post;
  - a pedal connected pivotally to the baseplate and having
    - a rear end connected pivotally to the baseplate near the rear end of the baseplate; and
    - a front end;
  - a rotating shaft having a non-circular cross section, mounted rotatably in the pivot holes in the posts and having two ends mounted respectively in the pivot holes in the posts; and
  - a drum hammer attached to and extended transversely from the rotating shaft and having
    - a distal end;
    - a proximal end; and
    - a through hole defined transversely near the proximal end of the drum hammer, having a non-circular cross section corresponding to the cross section of the rotating shaft and attached securely to the rotating shaft;
  - a drive device mounted on and rotated by the rotating shaft, connected to the front end of the pedal and having
    - a shaft connector being wedge shaped, mounted eccentrically on the rotating shaft and having
  - two sides;
- a transverse through hole formed through the shaft connector between the two sides and having a non-circular cross section corresponding to the cross section of the rotating shaft and mounted on the rotating shaft; and
  - a chain mounted with the shaft connector and the pedal and having
    - a proximal end connected to the front end of the pedal; and
    - a distal end mounted with the shaft connector; and
- a return device mounted on the rotating shaft between the posts, connected to one of the posts and the rotating shaft and having
  - a rotating bracket attached to the rotating shaft between the posts and having
    - a transverse mounting hole mounted securely on the rotating shaft and having a non-circular cross section corresponding to the non-circular cross section of the rotating shaft; and
    - a lower end;
  - a rotating connector attached pivotally to the lower end of the rotating bracket and having
    - an upper end attached pivotally to the rotating bracket;
    - a lower end; and
    - a transverse mounting hole formed transversely through the rotating connector near the lower end;
  - a spring attached pivotally to the transverse mounting hole in the rotating connector and having
    - an upper hook mounted pivotally in the transverse mounting hole in the rotating connector; and
    - a lower hook;
  - a stationary bracket attached to the post with the transverse through hole and having
    - a socket being tubular and having
      - a front end;
      - a rear end;
      - an internal cavity; and
      - an opening formed in the front end of the socket;
    - a threaded rod attached to and protruded longitudinally from the rear end of the socket and mounted through the transverse through hole in the post;
    - a fastener screwed onto the threaded rod and attached the stationary bracket to the post with the transverse through hole; and
    - a drive hole formed transversely through the socket near the front end and communicated with the internal cavity in the socket; and a pivoting connector mounted in the socket of the stationary bracket, connected to the lower hook of the spring and having two bearings mounted in the internal cavity of the socket, and each bearing having a center; and a transverse mounting hole formed through the center of the bearing;

a rotatable collar mounted rotatably in the internal cavity of the socket between the bearings and having two ends;

two mounting pins formed respectively on and extended from the ends of the rotatable collar and mounted respectively in the transverse mounting holes in the bearings; and a transverse through hole formed through the rotatable collar and communicating with the drive hole in the stationary bracket;

a drive column mounted pivotally in the stationary bracket, connected to the lower hook of the spring and having an upper end;

a lower end;

a connecting tab formed on the upper end and having a transverse mounting hole formed through the connecting tab and attached pivotally to the lower hook of the spring; and a threaded shaft extending through the transverse through hole in the rotatable collar and having a distal end; and a nut screwed onto the distal end of the threaded shaft to hold the drive column in the stationary bracket.

2. The adjustable drum pedal assembly as claimed in claim 1, wherein the transverse through hole formed through the post near the proximal end of the post is horizontally elongated; and the threaded rod of the stationary bracket is positioned in the elongated through hole to adjust the operation of the adjustable drum pedal assembly.

* * * * *